US009410326B2

(12) United States Patent
Albrecht et al.

(10) Patent No.: US 9,410,326 B2
(45) Date of Patent: Aug. 9, 2016

(54) AWNING SYSTEM

(71) Applicant: LIPPERT COMPONENTS, INC., Elkhart, IN (US)

(72) Inventors: Jeffrey K. Albrecht, Goshen, IN (US); Zachery B. Nelson, Elkhart, IN (US); Andrew J. Papczynski, Middlebury, IN (US); Brian M. Worthman, Goshen, IN (US); Michael J. Fiwek, Plymouth, IN (US); David G. Skinner, Elkhart, IN (US); Christopher S. Greer, Syracuse, IN (US)

(73) Assignee: LIPPERT COMPONENTS, INC., Elkhart, IN (US)

( * ) Notice: Subject to any disclaimer, the term of this patent is extended or adjusted under 35 U.S.C. 154(b) by 0 days.

(21) Appl. No.: 14/527,234

(22) Filed: Oct. 29, 2014

(65) Prior Publication Data

US 2015/0176285 A1 Jun. 25, 2015

Related U.S. Application Data

(60) Provisional application No. 61/897,563, filed on Oct. 30, 2013.

(51) Int. Cl.
*E04F 10/06* (2006.01)

(52) U.S. Cl.
CPC ..... *E04F 10/0614* (2013.01); *E04F 10/0625* (2013.01); *E04F 10/0651* (2013.01); *E04F 10/0629* (2013.01)

(58) Field of Classification Search
CPC ..... E04F 10/0625; E04F 10/0629
USPC ..... 160/67, 65, 69, 70, 71, 78, 79, 80; 135/88.12
See application file for complete search history.

(56) References Cited

U.S. PATENT DOCUMENTS

| | | | | | |
|---|---|---|---|---|---|
| 1,021,330 | A * | 3/1912 | Price | E04F 10/0614 | 160/78 |
| 1,742,437 | A * | 1/1930 | Davenport | E04F 10/0614 | 160/65 |
| 3,722,571 | A * | 3/1973 | Knight | E04F 10/0614 | 135/88.11 |
| 3,736,976 | A * | 6/1973 | Palmer | E04F 10/0614 | 160/242 |
| 6,095,221 | A * | 8/2000 | Frey, Jr. | E04F 10/0614 | 135/88.12 |
| 6,341,638 | B1 * | 1/2002 | Thompson | E04F 10/0614 | 160/67 |
| 6,488,069 | B1 * | 12/2002 | Mashaw | E04F 10/0614 | 160/262 |
| 6,971,433 | B2 * | 12/2005 | Wagner | E04F 10/0625 | 160/67 |
| 7,967,050 | B2 * | 6/2011 | Gutierrez | E04F 10/0603 | 160/67 |

* cited by examiner

*Primary Examiner* — David Purol
(74) *Attorney, Agent, or Firm* — Barnes & Thornburg LLP

(57) ABSTRACT

A retractable awning system includes an awning and a support structure therefor. The support structure includes a base and first, second, and third support arms. The awning is attached to a roller connected to the third support arm and to another structure. A telescopic actuator coupled to the first and second support arms is configured to bias the first, second, and third support arms to a deployed state. The awning may be wound onto the roller. Tension in the awning resulting from the rolling process causes the support structure to transition to a collapsed position.

17 Claims, 5 Drawing Sheets

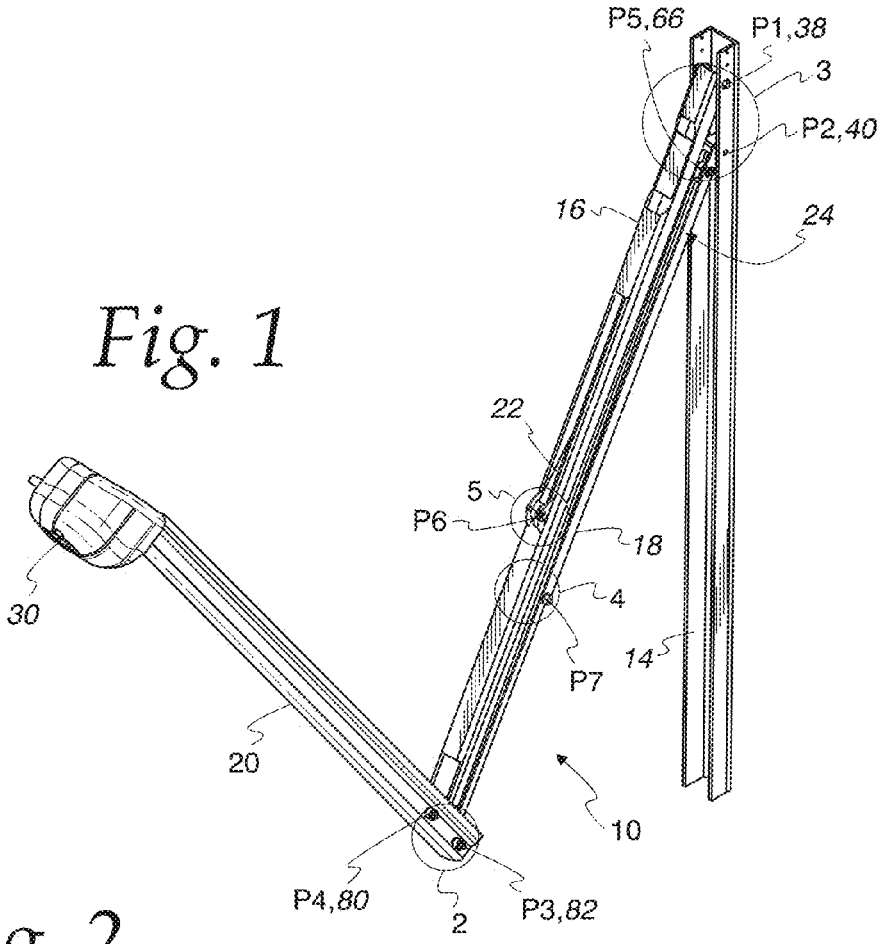
Fig. 1
Fig. 2
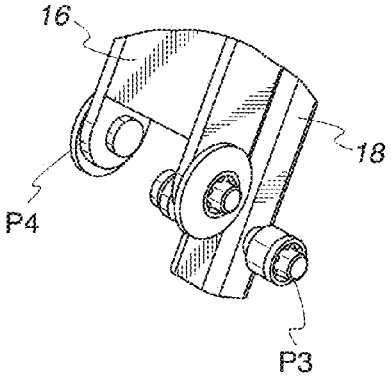
Fig. 3
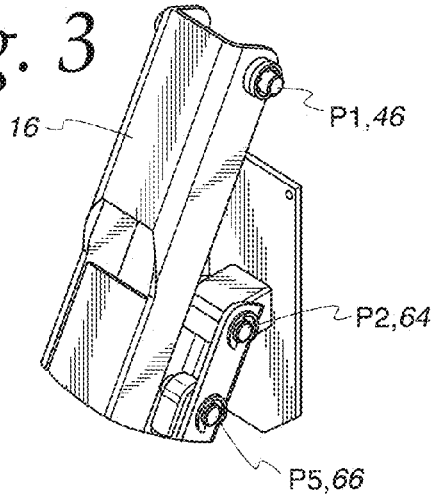

AWNING SYSTEM

CROSS-REFERENCE TO RELATED APPLICATIONS

This application claims benefit of U.S. Provisional Patent Application No. 61/897,563, filed on Oct. 30, 2013, and incorporates by reference the disclosure thereof in its entirety.

BACKGROUND OF THE INVENTION

Recreational vehicles, for example, motorhomes and travel trailers, often are provided with retractable awning systems. Such awning systems may include a roller, an awning fabric or canopy having a first end that is attached to and can be rolled onto and off of the roller, means for driving the roller so that the awning fabric may be rolled onto and off of the roller, and support structure for supporting the roller and the other ("free") end of the awning fabric when deployed from the roller. Either the roller or the free end of the awning fabric may be attached to the vehicle, and the other of the roller or the free end of the awning fabric may be attached to an extendable support structure.

Known extendable support structures generally fall into two categories: cantilevered supports and strut-type supports. Cantilevered supports typically include arms that extend outwardly, more or less horizontally, from an outer wall of the vehicle near the attachment of the roller or awning fabric to the vehicle. As such, cantilevered supports may be located entirely overhead so that they do not interfere with a person entering or exiting the space underneath the awning fabric. Cantilevered supports, however, may not be as robust as strut-type supports and may not be able to withstand loads as great as may be withstood by strut-type supports.

Strut-type supports typically include struts extending from a lower portion of a wall of a structure to which the awning and support structure may be attached. As such, strut-type supports can be more robust than cantilevered supports. Such struts, however, typically extend diagonally along the sides of the space covered by the awning, and obstruct entry to and exit from that space from and to the sides of that space.

BRIEF DESCRIPTION OF THE DRAWINGS

FIG. 1 is a perspective view of an awning and support system 10;

FIG. 2 is a detail view of a portion of awning and support system 10;

FIG. 3 is a detail view of another portion of awning and support system 10;

DETAILED DESCRIPTION OF THE DRAWINGS

Figure 4:
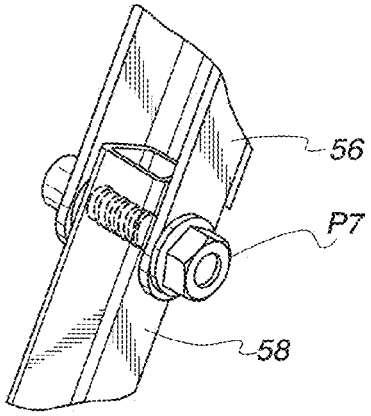
FIG. 4 is a detail view of a further portion of awning and support system 10.
Figure 5:
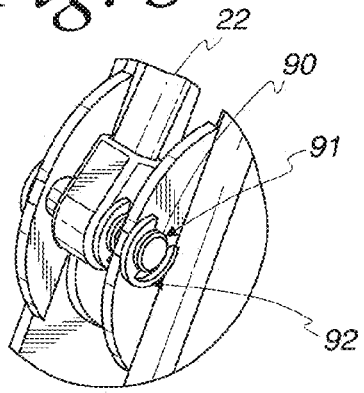
FIG. 5 is a detail view of yet another portion of awning and support system 10.
Figure 6:
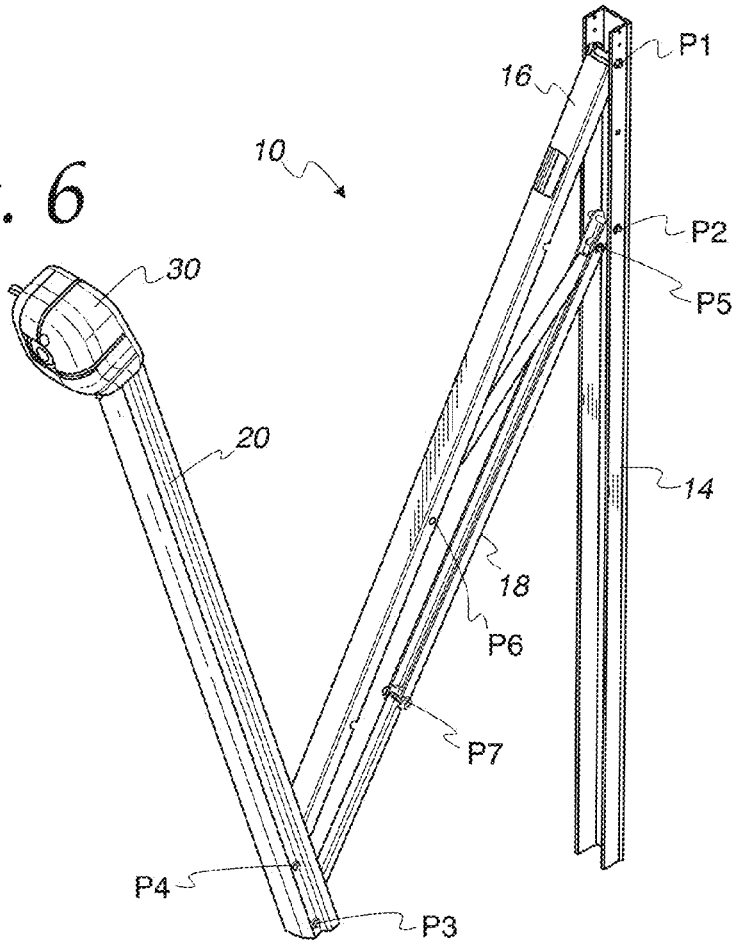
FIG. 6 is a second perspective view of awning and support system 10.
Figure 8:
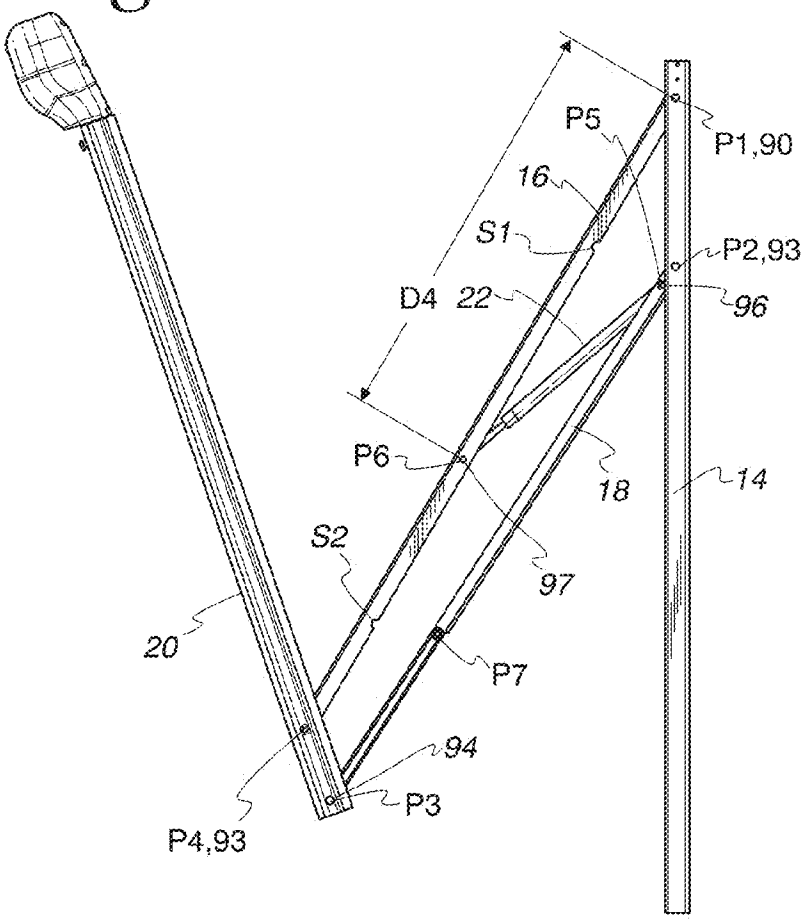
FIG. 8 is a right side elevation view of awning and support system 10.
Figure 7:
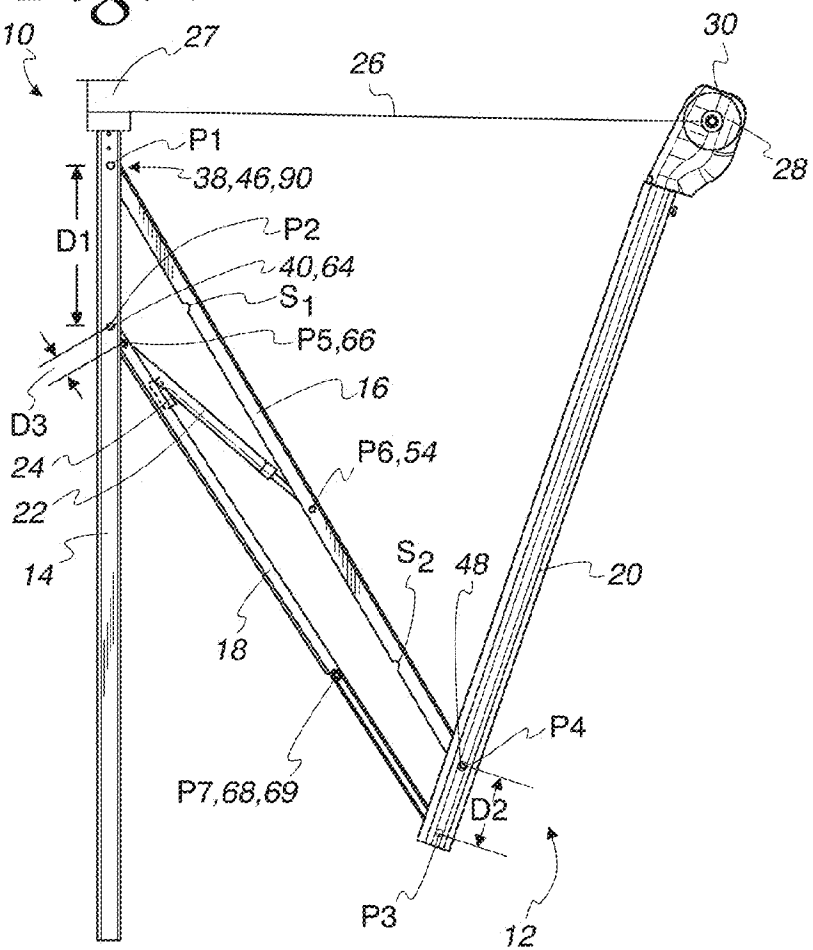
FIG. 7 is a left side elevation view of awning and support system 10.
Figure 9:
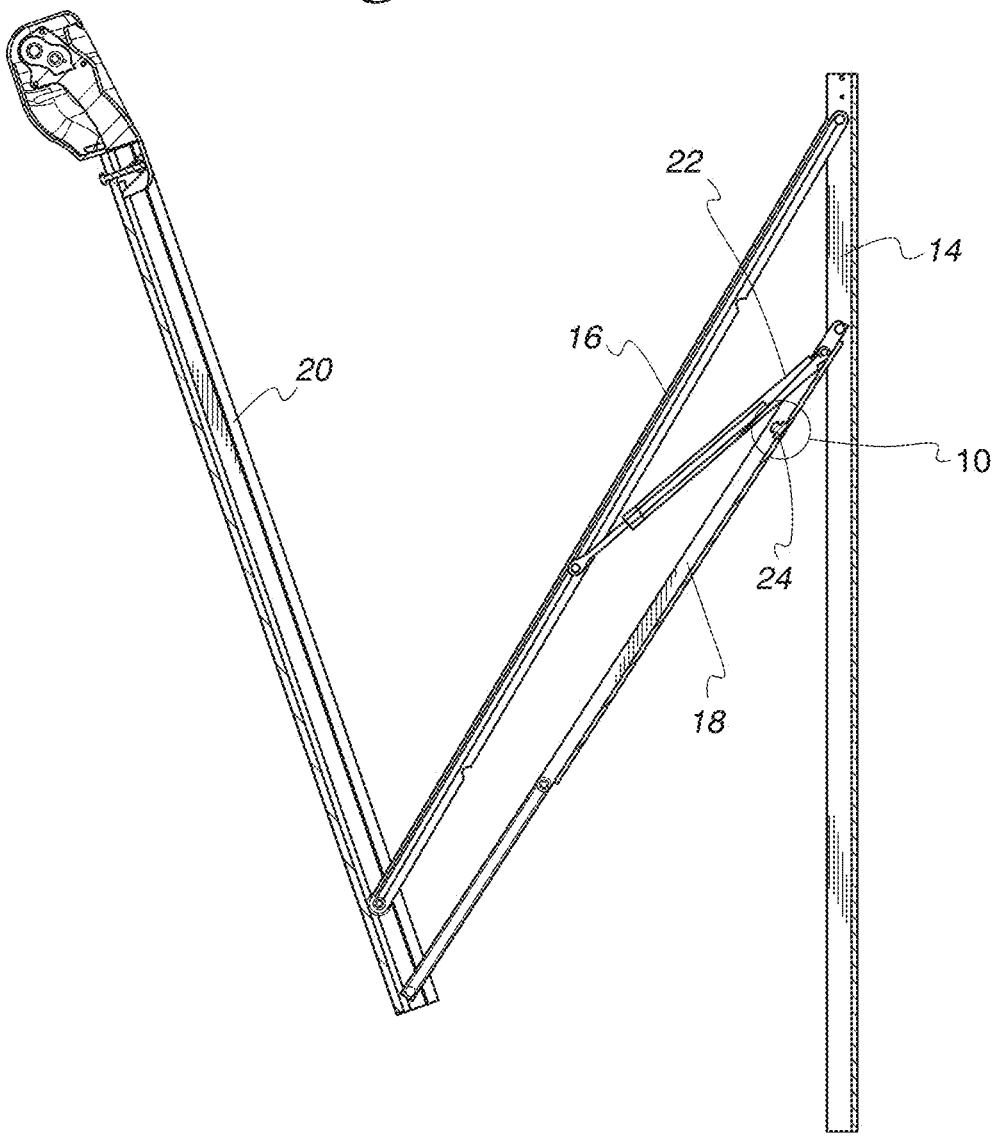
FIG. 9 is a cross-sectional right side elevation view of awning and support system 10.
Figure 10:
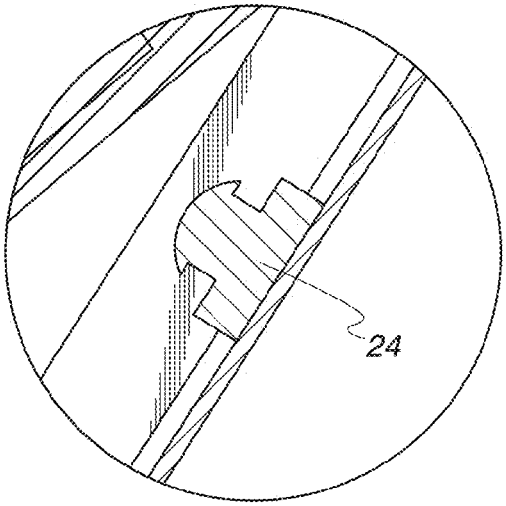
FIG. 10 is a detail view of yet a further portion of awning and support system 10.
Figure 11:
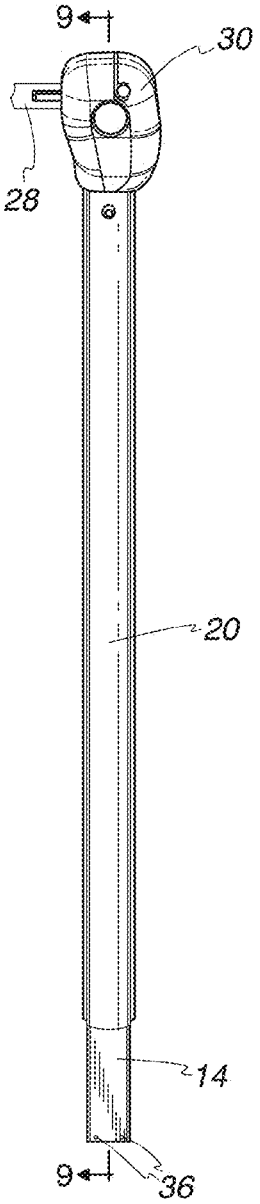
FIG. 11 is a front elevation view of a portion of awning and support system 10.

The drawings show illustrative embodiments of an awning and support system 10. System 10 includes two support structures 12. The two support structures 12 may be generally identical or mirror images of each other. Each support structure 12 includes a base 14, a first (or "upper") support arm 16, a second (or "lower") support arm 18, a third (or "roller") support arm 20, a telescopic actuator 22 and a biasing member 24. Base 14 may be mounted to, for example, a wall of a building or vehicle. Telescopic actuator 22 may be a pressurized gas strut having a housing and actuator rod, and may be configured to bias the actuator rod to an extended position and require application of a compressive force thereto to collapse the actuator rod into the housing. System 10 also includes an awning 26 and an awning roller 28.

A head unit 30 is attached to a first end of roller support arm 20. Awning roller 28 is located between and supported by head units 30 attached to the first ends of roller support arms 20. More specifically, a first end of roller 28 is supported by head unit 30 attached to a first end of roller support arm 20 of one of support structures 12, and a second end of roller 28 is supported by head unit 30 attached to the first end of roller support arm 20 of the other of support structures 12.

A first end (or "roller end") of awning 26 is attached to roller 28. A second end (or "free end") of awning 26 may be attached to another structure, for example, base 14 or a vehicle or building to which system 10 may be attached or to an integrated or intervening mounting structure 27. The head unit 30 attached to either or both of roller support arms 20 may include an electric drive motor or other means to selectively wind and unwind awning 26 onto and off of roller 28.

A first end of upper support arm 16 is rotatably connected to base 14 at a first pivot point Pl. First pivot point P1 may be located near or further inboard from a first (or "upper") end of base 12. A first end of lower support arm 18 is rotatably connected to base 14 at a second pivot point P2. Second pivot point P2 is distanced from first pivot point P1 by a first distance D1 toward a second (or "lower") end of base 12.

A second end of lower support arm 18 is rotatably connected to roller support arm 20 at a third pivot point P3. Third pivot point P3 may be located near or further inboard from a second end of roller support arm 20. A second end of upper support arm 16 is rotatably connected to roller support arm 20 at a fourth pivot point P4. Fourth pivot point P4 is distanced from third pivot point P3 by a second distance D2 toward the first end of roller support arm 20.

A first end of telescopic actuator 22 is rotatably connected to lower support arm 18 at a fifth pivot point P5. Fifth pivot point P5 is located near but is separated from second pivot point P2 by a third distance D3 toward the second end of lower support arm 18. A second end of telescopic actuator 22 is rotatably connected to upper support arm 16 at a sixth pivot point P6. Sixth pivot point P6 is located intermediate first pivot point P1 and fourth pivot point P4.

System 10 may be selectively operated between a deployed state and a collapsed state. In the deployed state, upper support arm 16, lower support arm 18, roller support arm 20 and telescopic actuator 22 extend away from base 12 in a direction generally (though not necessarily absolutely) perpendicular thereto. Also, in the deployed state, awning 26 may be extended away from the structure to which the free end thereof is attached such that awning 26 is pitched with respect to the structure or generally perpendicular to the structure. If system 10 is attached to a building or a vehicle that is level with respect to level ground, the awning may be parallel to the ground or "flat."

Telescopic actuator 22 imparts a force to upper support arm 16 and lower support arm 18 at pivot points P5 and P6. This force tends to rotate upper support arm 16 and lower support arm 18 about pivot points P1 and P2, respectively, toward the extended position described above, and to maintain upper support arm 16 and lower support arm 18 in this extended position. Upper support arm 16 and lower support arm 18, in turn, impart forces to roller support arm 20 at pivot points P3 and P4. These forces cause roller support arm 20 to rotate about pivot points P3 and P4 to the extended position described above. These forces also tend to maintain roller support arm 20 in this extended position. The foregoing forces may be counteracted by tension in awning 26 between roller 28 and the structure to which awning 26 is attached.

System 10 may be transitioned to a collapsed state by winding awning 26 onto roller 28. The tension in awning 26 as awning 26 is rolled onto roller 28 imparts a force on upper support arm 20. This force counteracts the force applied to pivot points P3 and P4 by lower support arm 18 and upper support arm 16, respectively, and causes upper support arm 20 to rotate about pivot point P3 and pivot point P4 toward a collapsed position, as will be discussed further below. Upper support arm 16 and lower support arm 18, in turn, apply a compressive force to telescopic actuator 22 at pivot points P5 and P6, thereby collapsing the actuator rod of telescopic actuator 22 into the body or housing thereof. At the same time, upper support arm 16 rotates about pivot point P1 and second support arm 18 rotates about pivot point P2 toward collapsed positions, as discussed further below.

In the collapsed state, awning 26 is wound around roller 28, and upper support arm 16, lower support arm 18, roller support arm 20 and telescopic actuator 22 are collapsed generally against, and may be nested within, base 14. Also, in the collapsed state, biasing member 24 is compressed between base 14 and lower support arm 18 or between lower support arm 18 and telescopic actuator 22. As such, biasing member 24 imparts a force between the foregoing pairs of components. Additionally, in the collapsed state, telescopic actuator 22 imparts a force on upper support arm 16 at pivot point P6, causing upper support arm 16 to bow outwardly from base 14 between pivot points P1 and P4. More specifically, the travel of the actuator rod of telescopic actuator 22 relative to the body thereof is limited and the relative locations of pivot points P5 and P6 are selected such that such that the compressive travel limit of the actuator rod of telescopic actuator 22 relative to the body thereof is reached before the rotational travel limit of upper support arm 16 toward base 14 is reached. As such, the second end of upper support arm 26 continues to rotate toward base 14 after the rod of telescopic actuator 22 has reached its travel limit relative the base thereof and can be no further compressed, thereby imparting onto upper support arm 16 a bending stress about pivot point P6 and/or causing upper support arm 26 to bend about pivot point P6. The travel limit of the rod relative to the body of actuator 22 may be due to, for example, the rod bottoming out within the housing, or by means of an internal or external stop device that limits such travel.

In order to deploy awning 26 and support structure 12, awning 26 is unwound from roller 28. The release of tension in awning 26 further to the unrolling thereof allows the bending stress placed upon upper support arm 16 during the collapsing process, as described above, to be relieved. The relief of the bending stress causes upper support arm 16 to straighten out such that pivot point P4 moves away from base 14. At about the same time, the force imparted by biasing member 24 on lower support arm 18 and telescopic actuator 22 or telescopic actuator 22 and upper support 16 pushes the body of telescopic actuator 22 away from lower support arm 18 (or pushes lower support arm 18 away from base 14), thereby initially displacing upper support arm 16 and lower support arm 18 from the collapsed position. Further deployment of support structures 12 is driven by the telescopic action of telescopic actuator 22.

As discussed above, each support structure 12 includes a base 14, a first or upper support arm 16, a second or lower support arm 18, a third or roller support arm 20, a telescopic actuator 22 and a biasing member 24. Base 12 is shown is an elongated, generally C-shaped channel having a bottom 32 and sides 34 extending generally perpendicularly from first and second edges of bottom 32. Bottom 32 and sides 34 cooperate to define an interior region of base 12. Bottom 32 of base 12 may define one or more apertures 36 for receiving fasteners (not shown) that may be used to attach base 12 to a structure, for example, a building, motorhome, or travel trailer. Sides 34 of base 12 may include apertures 38, 40 for receiving pins or other means for connecting first support arm 16 and second support arm 18 thereto, as will be discussed further below. Apertures 38 may be located near a first end of base 12. Apertures 40 may be located near apertures 38 and toward a second end of base 12 relative to apertures 38. Bottom 32 and/or sides 34 of base 12 may be generally planar, or they may have cross-sectional shapes, as shown, to enhance the rigidity or other structural characteristics of base 12. Sides 34 of base 12 are configured to receive first support arm 16, second support arm 18 and telescopic actuator 22 there between when support structure 12 is in a collapsed state, as will be discussed further below.

Upper support arm 16 is shown as an elongated, generally C-shaped channel having a bottom 42 and sides 44 extending generally perpendicularly from first and second edges of bottom 42. Bottom 42 and sides 44 cooperate to define an interior region of first support arm 16. Sides 44 define apertures 46, 48 for receiving pins or other means for connecting first support arm 16 to base 12 and third support arm 20 thereto, as will be discussed further below. Apertures 46 are located near a first end of first support arm 16, and apertures 48 are located near a second end of first support arm 16. Scallops S1 may be provided at the free edges of sides 44 to provide clearance for hardware at pivot point P2. Scallops S2 may be provided at the free edges of sides 44 to provide clearance for hardware at pitch adjustment pivot point P7, as discussed further below. Sides 44 further define apertures 54 for receiving pins or other means for connecting telescopic actuator 22 to upper support arm 16, as will be discussed further below.

Lower support arm 18 is shown as having a first section 56 and a second section 58. First section 56 is shown as an elongated, generally C-shaped channel having a bottom 60 and sides 62 extending generally perpendicular from first and second edges of bottom 60. Bottom 60 and sides 62 cooperate to form an interior region of first section 56 of second support arm 18. Sides 62 define apertures 64 for receiving a pin or other means for connecting second support arm 18 to base 14, as will be discussed further below. Apertures 64 are located near a first end of second support arm 18. The portion of sides 62 defining apertures 64 may extend beyond bottom 60. Sides 62 also define apertures 66 for receiving pins or other means for connecting telescopic actuator 22 to lower support arm 18, as will be discussed further below. Sides 62 further define apertures 68 for receiving pins or other means for connecting first section 56 of lower support arm 18 to second section 58 of lower support arm 18, as discussed further below. The portion of sides 62 defining apertures 68 may extend beyond bottom 60.

Second section 58 of lower support arm 18 is shown as a square tubular member but could be a C-shaped channel or other member. A first of second section 58 defines apertures 69 for receiving a pin or other means for connecting first section 56 of lower support arm 18 to second section 58 of lower support arm 18, as discussed further above. In an embodiment, such pinning means could be a nut and bolt made of, for example, stainless steel, inserted through apertures 68 and 69. A Belleville washer may be provided between the head of the bolt an outer surface of one of sides 62 of first section 56 of lower support arm 18. Another Belleville washer may be provided between the nut and an outer surface of the other of sides 62 of first section 56 of lower support arm 18. This connection defines pivot point P7. Normally, first and second sections 56, 58 are collinear. First section 56 may be rotated about pivot point P7 with respect to second section 58 in order to alter the pitch of awning 26 when deployed. The Belleville washer arrangement may serve to maintain the rotated (or non-collinear) position of first section 56 with respect to second section 58.

Roller support arm 20 is shown as an elongated, generally C-shaped channel, having a bottom 76 and sides 78 extending generally perpendicular from first and second edges of bottom 76. Bottom 76 and sides 78 cooperate to define an interior region of third support arm 20. Sides 78 of third support arm 20 define apertures 80, 82 for receiving pins or other means for connecting first support arm 16 and second support arm 18 to third support arm 20, as will be discussed further below. Sides 78 of third support arm 20 are configured to receive sides 44 of first support arm and to overlap sides 34 of base 12 when support structure 12 is in collapsed state, as will be discussed further below.

A first end of upper support arm 16 is rotatably connected to base 12 by aligning apertures 46 of upper support arm 16 with apertures 38 of base 12 and inserting a pin 90 or similar pinning means, for example, a nut and bolt arrangement, through the foregoing apertures. Bushings and/or bearings may be included at this connection as desired. Pin 90 may have a head portion and a shank portion. The shank portion may define a groove 91 at an end thereof opposite head portion. The groove may receive a c-clip 92 to retain pin 90 within the foregoing apertures. This connection defines first pivot point P1.

A first end of lower support arm 18 is rotatably connected to base 12 by aligning apertures 64 of lower support arm 18 with apertures 40 of base 14 and inserting a pin 93 through such apertures. Pin 93 may be configured in a manner similar to pin 90 described above and have similar retaining means. This connection defines second pivot point P2.

A second end of lower support arm 18 is rotatably connected to roller support arm 20 by aligning apertures 67 of lower support arm 18 with apertures 82 of roller support arm 20 and inserting pin 94 through such apertures. Pin 94 may be similar to pin 90 described above and have similar retaining means. This connection defines third pivot point P3.

A second end of upper support arm 16 is connected to roller support arm 20 by aligning apertures 48 of upper support arm with apertures 80 of roller support arm and inserting pin 95 through such apertures. Pin 95 may be similar to pin 90 described above and have similar retaining means. This connection defines fourth pivot point P4.

A first end of telescopic actuator 22 is rotatably connected to lower support arm 16 by aligning apertures 66 of lower support arm 18 with an aperture at the first end of telescopic actuator 22 and inserting pin 96 through such apertures. Pin 96 may be similar to pin 90 described above and have similar retaining means. This connection defines fifth pivot point P5.

A second end of telescopic actuator 22 is rotatably connected to upper support arm 16 by aligning apertures 54 of upper support arm 16 with an aperture at the second end of telescopic actuator 22 and inserting pin 97 through such apertures. Pin 97 may be similar to pin 90 described above and have similar retaining means. This connection defines sixth pivot point P6.

Biasing member 24 is shown as a compressible and resilient rubber bumper disposed between telescopic actuator 22 and lower support arm 18. Alternatively, biasing member 24 could be a spring or other structure suitable for biasing lower support arm 18 relative to telescopic actuator 22 or relative to base 14, as discussed further above.

Distances D1, D2 and D3 may be selected as desired to yield a desired orientation or pitch of awning 26 relative to the structure to which system 10 is attached when awning 26 is deployed, and to allow system 10 to be collapsed as discussed above.

To the extent dimensions may be provided in the drawings, the dimensions are illustrative and may be scaled or otherwise changed as desired to yield a particular result.

Terms of orientation such as "upper" and "lower" as used herein should not be interpreted in an absolute sense but instead as indicators of relative orientation.

One or more embodiments are described and/or shown herein for illustrative purposes and should not be construed to limit the scope of the underlying invention. The disclosed embodiments could be modified without departing from the scope of the invention. For example, it might be possible to relocate biasing member 24 to a position between upper support arm 16 and telescopic actuator 22. Also, the roller and head unit could be located on the structure to which system 10 may be attached, and the free end of awning 26 could be attached to a header (not shown) spanning the first ends of roller support arms 20.

The invention claimed is:

1. An awning support system comprising:

a base configured for attachment to a structure, said base comprising a first pivot point and a second pivot point spaced apart from said first pivot point;

a first support arm rotatably connected to said base at said first pivot point;

a second support arm rotatably connected to said base at said second pivot point;

a third support arm defining a third pivot point and a fourth pivot point spaced apart from said third pivot point, said third support arm rotatably connected to said second support arm at said third pivot point and said third support arm rotatably connected to said first support arm at said fourth pivot point;

a telescopic actuator having a first end rotatably connected to said second support arm at a fifth pivot point and a second end rotatably connected to said first support arm at a sixth pivot point; and a biasing member disposed between said telescopic actuator and said second support arm or between said second support arm and said base, said biasing member configured to bias said second support arm apart from said telescopic actuator or said base, respectively, when said first, second, and third support arms are in said second position;

wherein said first, second, and third support arms are movable between a first position in which said first, second, and third support arms extend away from said base and a second position in which said first, second, and third support arms are positioned proximate said base; and wherein said first support arm is elastically bent when said first, second, and third support arms are in said second position.

2. The system of claim 1 wherein said biasing member is disposed between said telescopic actuator and said second support arm.

3. The system of claim 1 wherein said biasing member is disposed between said second support arm and said base.

4. The system of claim 1 wherein said second support arm comprises a first section and a second section rotatably connected to said first section at a seventh pivot point.

5. The system of claim 4 wherein said seventh pivot point selectively maintains said first section in a non-collinear orientation with respect to said second section.

6. The system of claim 4 wherein said seventh pivot point comprises a Belleville washer.

7. The system of claim 1 wherein said first, second, and third support arms nest in said base when said first, second, and third support arms are in said second position.

8. The system of claim 1 wherein said fifth pivot point is between said second pivot point and said third pivot point.

9. The system of claim 1 further comprising a head unit connected to said third support arm.

10. An awning system comprising a pair of awning support systems as recited in claim 8 and an awning roller connected between said head unit of a first of said awning support systems and said head unit of a second of said awning support systems.

11. An awning support system comprising:

a base configured for attachment to a structure, said base comprising a first pivot point and a second pivot point spaced apart from said first pivot point;

a first support arm rotatably connected to said base at said first pivot point;

a second support arm rotatably connected to said base at said second pivot point;

a third support arm defining a third pivot point and a fourth pivot point spaced apart from said third pivot point, said third support arm rotatably connected to said second support arm at said third pivot point and said third support arm rotatably connected to said first support arm at said fourth pivot point; and a telescopic actuator having a first end rotatably connected to said second support arm at a fifth pivot point and a second end rotatably connected to said first support arm at a sixth pivot point; and wherein said first, second, and third support arms are movable between a first position in which said first, second, and third support arms extend away from said base and a second position in which said first, second, and third support arms are positioned proximate said base; and wherein said first support arm is elastically bent when said first support arm when said first, second, and third support arms are in said second position.

12. The system of claim 11 wherein said second support arm comprises a first section and a second section rotatably connected to said first section at a seventh pivot point.

13. The system of claim 12 wherein said seventh pivot point selectively maintains said first section in a non-collinear orientation with respect to said second section.

14. The system of claim 11 further comprising a head unit connected to said third support arm.

15. An awning system comprising a pair of awning support systems as recited in claim 14 and an awning roller connected between said head unit of a first of said awning support systems and said head unit of a second of said awning support systems.

16. The system of claim 11 wherein said second support arm comprises a first section and a second section rotatably connected to said first section at a seventh pivot point.

17. The system of claim 12 wherein said seventh pivot point selectively maintains said first section in a non-collinear orientation with respect to said second section.

* * * * *